US009755317B2

(12) United States Patent
Grelier et al.

(10) Patent No.: US 9,755,317 B2
(45) Date of Patent: Sep. 5, 2017

(54) BROADBAND ANTENNA REFLECTOR FOR A CIRCULAR-POLARIZED PLANAR WIRE ANTENNA AND METHOD FOR PRODUCING SAID ANTENNA REFLECTOR

(75) Inventors: Michael Grelier, Paris (FR); Michel Jousset, Ploumoguer (FR); Stéphane Mallegol, Saint Seve (FR); Xavier Begaud, Neuilly Plaisance (FR)

(73) Assignee: Thales, Courbevoie (FR)

( * ) Notice: Subject to any disclaimer, the term of this patent is extended or adjusted under 35 U.S.C. 154(b) by 573 days.

(21) Appl. No.: 13/876,909

(22) PCT Filed: Sep. 23, 2011

(86) PCT No.: PCT/EP2011/066563

§ 371 (c)(1),
(2), (4) Date: Jun. 5, 2013

(87) PCT Pub. No.: WO2012/041770

PCT Pub. Date: Apr. 5, 2012

(65) Prior Publication Data

US 2013/0249762 A1 Sep. 26, 2013

(30) Foreign Application Priority Data

Oct. 1, 2010 (FR) ..... 10 03900

(51) Int. Cl.
*H01Q 9/27* (2006.01)
*H01Q 11/08* (2006.01)
(Continued)

(52) U.S. Cl.
CPC ..... *H01Q 15/14* (2013.01); *H01Q 9/27* (2013.01); *H01Q 19/10* (2013.01); *H01Q 19/18* (2013.01); *H01Q 19/185* (2013.01); *H01Q 11/08* (2013.01); *H01Q 11/083* (2013.01); *H01Q 11/10* (2013.01)

(58) Field of Classification Search
CPC ..... H01Q 15/14; H01Q 19/18; H01Q 19/185; H01Q 19/127; H01Q 9/27; H01Q 19/27;
(Continued)

(56) References Cited

U.S. PATENT DOCUMENTS 3,358,288 A * 12/1967 Gerard Dubost ..... H01Q 9/27 343/789
3,745,585 A * 7/1973 Barbano ..... H01Q 1/36 343/792.5
(Continued)

FOREIGN PATENT DOCUMENTS

DE 10034547 * 7/2000
DE 10034547 * 1/2002
(Continued)

*Primary Examiner* — Jessica Han
*Assistant Examiner* — Awat Salih
(74) *Attorney, Agent, or Firm* — Baker Hostetler LLP

(57) ABSTRACT

In the field of circular-polarized planar wire antennas for very wide band telecommunications systems, and an antenna reflector for such an antenna, an antenna device comprises an antenna reflector and an antenna, and a method for implementing the antenna reflector. The antenna reflector comprises, on the one hand, a first reflection region exhibiting electromagnetic properties of an electrical conductor in a first sub-band of frequencies and, on the other hand, a second reflection region exhibiting electromagnetic properties akin to a magnetic conductor in a second sub-band of frequencies. Each reflection region is designed to face a region of the antenna able to emit electromagnetic radiation in the corresponding sub-band of frequencies in order to reflect the electric field of the backward radiation in phase with the electric field of the forward radiation.

13 Claims, 3 Drawing Sheets

(51) Int. Cl.

| | |
|---|---|
| ***H01Q 15/14*** | (2006.01) |
| ***H01Q 19/10*** | (2006.01) |
| ***H01Q 19/18*** | (2006.01) |
| ***H01Q 19/185*** | (2006.01) |
| *H01Q 1/36* | (2006.01) |
| *H01Q 11/10* | (2006.01) |

(58) Field of Classification Search

CPC .. H01Q 19/10; H01Q 9/0407; H01Q 15/0046; H01Q 11/08; H01Q 1/362; H01Q 1/36; H01Q 1/38; H01Q 15/161; H01Q 15/0013; H01Q 1/08; H01Q 11/10; H01Q 11/083

USPC ..... 343/895, 912, 913, 909, 846, 756, 755, 343/789, 837

See application file for complete search history.

(56) References Cited

U.S. PATENT DOCUMENTS

| | | | | | |
|---|---|---|---|---|---|
| 4,608,572 | A * | 8/1986 | Blakney | H01Q 1/48 | 343/792.5 |
| 5,351,063 | A * | 9/1994 | Kim | H01Q 9/27 | 343/701 |
| 5,990,849 | A * | 11/1999 | Salvail | H01Q 9/27 | 343/729 |
| 6,067,058 | A * | 5/2000 | Volman | H01Q 1/36 | 343/846 |
| 6,219,006 | B1 * | 4/2001 | Rudish | 343/895 | |
| 2006/0220958 | A1 * | 10/2006 | Saegrov | H01Q 9/0407 | 343/700 MS |
| 2009/0079637 | A1 * | 3/2009 | Fukui | H01Q 1/241 | 343/700 MS |
| 2010/0149060 | A1 * | 6/2010 | Lin et al. | 343/767 | |
| 2010/0271267 | A1 * | 10/2010 | Roth | H01Q 9/27 | 343/700 MS |

FOREIGN PATENT DOCUMENTS

| | | | |
|---|---|---|---|
| DE | 010034547 | A1 * | 1/2002 |
| DE | 10034547 | A1 | 1/2002 |
| FR | 002922687 | * | 10/2007 |
| FR | EP2365584 | * | 3/2011 |
| GB | 2132022 | * | 5/1982 |
| GB | 002132022 | A * | 6/1982 |
| GB | 2132022 | * | 6/1984 |
| GB | 2253743 | * | 9/1992 |
| JP | 357083901 | * | 5/1982 |
| JP | 02007096868 | * | 9/2005 |
| JP | 02008219125 | * | 2/2007 |
| JP | 02011211420 | * | 3/2010 |

* cited by examiner

BROADBAND ANTENNA REFLECTOR FOR A CIRCULAR-POLARIZED PLANAR WIRE ANTENNA AND METHOD FOR PRODUCING SAID ANTENNA REFLECTOR

CROSS-REFERENCE TO RELATED APPLICATIONS

This application is a National Stage of International patent application PCT/EP2011/066563, filed on Sep. 23, 2011, which claims priority to foreign French patent application No. FR 1003900, filed on Oct. 1, 2010, the disclosures of which are incorporated by reference in their entirety.

FIELD OF THE INVENTION

The invention is applicable to the field of circular-polarized planar wire antennas for broadband transmitter or receiver devices. It relates to an antenna reflector for such an antenna, an antenna device comprising the reflector and the antenna, and a method for implementing the antenna reflector.

BACKGROUND

In the framework of certain applications, the antennas must have a wide band of operating frequencies, for example of the order of a decade, in other words a frequency band whose maximum frequency is equal to at least ten times the minimum frequency. Circular-polarized planar wire antennas, such as spiral antennas, belong to these wide frequency band antennas. A spiral antenna is generally composed of a dielectric substrate into which a radiating element is etched. The radiating element comprises at least two strands wound into a spiral whose inner ends are supplied with current. The electromagnetic radiation from the spiral antenna varies depending on the number of strands and the phase of the current in each strand. The width of the frequency band depends on the inner and outer diameters of the spiral.

From a theoretical point of view, a planar wire antenna possesses a plane of symmetry and therefore radiates into the whole of space, in particular in the two directions orthogonal to the plane of the antenna. For reasons of electromagnetic compatibility, the antennas must not interfere with the other systems situated nearby. Consequently, they are very often specified so as to radiate into a half-space. For this reason, the antenna is associated with a reflector which transforms the bidirectional radiation into a unidirectional radiation. From a practical point of view, this reflector also serves as a support allowing the antenna to be made more rigid and to be supplied with current.

According to a first solution, the reflector comprises an electrically conducting plane disposed at a distance from the antenna equal to a quarter of the mean wavelength of the radiation that it emits or that it receives. At such a distance, the electric field of the reflected backward radiation is then in phase with the electric field of the forward radiation. The main drawback of this solution is that the distance can only be adjusted in an optimal manner for a single wavelength. The electric field of the radiation emitted or received at wavelengths far from this mean wavelength therefore risk being affected, thus limiting the bandwidth of the antenna. Another drawback of this solution is that a quarter of a wavelength quickly corresponds to a large distance for low frequencies, which quickly leads to an overall relatively large thickness for the antenna. Furthermore, the electrically conducting plane allows the propagation of surface currents and reflection and scattering phenomena occur at the edge of the antenna, thus generating spurious radiation.

According to a second solution, the antenna reflector comprises a structure of the Artificial Magnetic Conductor (AMC) type disposed under the plane of the antenna on the side of the backward radiation. A conventional AMC structure comprises a dielectric substrate, electrically-conducting patterns disposed periodically on a first surface of the dielectric substrate and a uniform electrically-conducting plane forming a ground plane on a second surface of the dielectric substrate. Each conducting pattern can be connected to the ground plane via interconnection holes, generally referred to as "vias" in the literature. An AMC structure possesses the property of reflecting the electric field of the backward radiation in phase with the electric field of the forward radiation. It can therefore be positioned very close to the antenna and allows a reduction in the thickness of the antenna device comprising the antenna and the AMC structure. An AMC structure can also possess the property of prohibiting the propagation of electromagnetic waves in certain directions of the plane in which the conducting patterns are disposed, which prevents any spurious radiation from being generated. This is referred to as an electromagnetic band gap (EBG) structure. However, the properties of a structure of the EBG or AMC type are only manifest within a certain band of frequencies, referred to either as EBG band or as AMC band depending on the case in question. This band of frequencies, notably its central frequency and its low and high cutoff frequencies, depends on the shape and on the dimensions of the conducting patterns, and also on the thickness and on the relative permittivity of the dielectric substrate of the structure. In particular, for a relatively limited thickness of the dielectric substrate, in other words very small compared to the wavelength, whether either the EBG band or the AMC band are considered, the bandwidth is very narrow, in other words much less than an octave. Thus, the constraints relating to the thickness mean that the current antennas comprising a reflector with an EBG or AMC structure do not allow operation over a wide band of frequencies, greater than a decade.

SUMMARY OF THE INVENTION

One aim of the invention is notably to overcome the aforementioned drawbacks by providing an antenna reflector with a wide frequency band and having a reduced thickness based on a hybrid structure. This hybrid structure comprises both an electrically conducting plane of the type of the first solution and a structure of the AMC type based on the second solution. For this purpose, one subject of the invention is an antenna reflector locally exhibiting either electromagnetic properties of an electrical conductor, or electromagnetic properties akin to a magnetic conductor, depending on the radiation emitted or received locally by the antenna. More particularly, one subject of the invention is an antenna reflector onto which a circular-polarized planar wire antenna can be mounted that is capable of emitting electromagnetic radiation in two directions orthogonal to the plane of the antenna over a predetermined frequency band, the antenna reflector being characterized in that it comprises:

- a first reflection region designed to reflect, with a phase-shift close to 180 degrees, an electric field of the electromagnetic radiation referred to as backward radiation whose frequency is included within a first sub-band of frequencies, the first reflection region being designed to face a region of the antenna able to emit electromagnetic radiation in the first sub-band of frequencies, at a distance allowing the electric field of the backward electromagnetic radiation to be reflected substantially in phase with the electric field of the electromagnetic radiation referred to as forward radiation, and a second reflection region designed to reflect, with a phase-shift included between two values of angle on either side of the value of zero degrees, the electric field of the backward electromagnetic radiation whose frequency is included within a second sub-band of frequencies, the second reflection region being designed to face a region of the antenna able to emit electromagnetic radiation in the second sub-band of frequencies, at a distance allowing the electric field of the backward electromagnetic radiation to be reflected substantially in phase with the electric field of the forward electromagnetic radiation.

The reflector may comprise several reflection regions each designed to reflect, with a phase-shift included between two values on either side of the value of zero degrees, the electric field of the backward electromagnetic radiation whose frequency is included within a sub-band of frequencies. Each reflection region is then designed to face a region of the antenna able to emit electromagnetic radiation in the sub-band of frequencies in question, at a distance allowing the electric field of the backward electromagnetic radiation to be reflected substantially in phase with the electric field of the forward electromagnetic radiation.

Similarly, the reflector may comprise several reflection regions each designed to reflect, with a phase-shift close to 180 degrees, the electric field of the backward electromagnetic radiation whose frequency is included within a sub-band of frequencies. Each reflection region is then designed to face a region of the antenna able to emit electromagnetic radiation in the sub-band of frequencies in question, at a distance allowing the electric field of the backward electromagnetic radiation to be reflected substantially in phase with the electric field of the forward electromagnetic radiation.

According to one particular embodiment, the first sub-band of frequencies corresponds to the highest frequencies of the predetermined frequency band. The reflector can thus be placed at a distance from the antenna substantially equal to a quarter of the wavelength of the central frequency of this sub-band of frequencies, this being relatively close to the antenna.

Advantageously, the sub-bands of frequencies, taken as a whole, cover substantially the whole of the predetermined frequency band. The electric field of the backward electromagnetic radiation can thus be in phase with the electric field of the forward electromagnetic radiation over the whole frequency band of the antenna.

The reflector may comprise a substrate made of dielectric material and a ground plane formed on a first surface of the substrate, the first reflection region being formed on a second surface of the substrate by an electrically conducting pattern, the other reflection region or regions each being formed on the second surface of the substrate by a set of electrically-conducting patterns disposed in a non-conjoined manner.

According to a first embodiment, the first and second surfaces of the substrate are substantially plane and parallel to each other. According to a second embodiment, the second surface of the substrate has a conical shape.

The electrically-conducting patterns of the sets forming reflection regions designed to reflect the electric field of the backward electromagnetic radiation with a phase-shift included between two values on either side of the value of zero degrees can be electrically connected to the ground plane.

According to one particular embodiment, the two values of angle on either side of the value of zero degrees are substantially equal to −120 degrees and +120 degrees.

Another subject of the invention is an antenna device comprising a circular-polarized planar wire antenna capable of emitting electromagnetic radiation over a predetermined frequency band and an antenna reflector according to the invention.

Another subject of the invention is a method for implementing the antenna reflector according to the invention. The method comprises the following steps:

a step for determining, in a near-field region, an amplitude distribution of an electromagnetic radiation able to be emitted by the antenna in the absence of the antenna reflector for at least a first and a second sub-band of frequencies belonging to the predetermined frequency band, a step for determining the shape and dimensions of a first reflection region of the antenna reflector designed to reflect, with a phase-shift close to 180 degrees, an electric field of the electromagnetic radiation referred to as backward radiation whose frequency is included in the first sub-band of frequencies, in such a manner that this reflection region can be situated facing the region of the antenna where the electromagnetic radiation able to be emitted by the antenna in the first sub-band of frequencies has the highest amplitude, at a distance allowing the electric field of the backward electromagnetic radiation to be reflected substantially in phase with the electric field of the electromagnetic radiation referred to as forward radiation, and a step for determining the shape and dimensions of a second reflection region of the antenna reflector designed to reflect, with a phase-shift included between two values of angle on either side of the value of zero degrees, the electric field of the backward electromagnetic radiation whose frequency is included in the second sub-band of frequencies, in such a manner that this reflection region can be situated facing the region of the antenna where the electromagnetic radiation able to be emitted by the antenna in the second sub-band of frequencies has the highest amplitude, at a distance allowing the electric field of the backward electromagnetic radiation to be reflected substantially in phase with the electric field of the forward electromagnetic radiation.

The method may comprise the following additional steps:

a step for determining a minimum distance $d_{Emin}$ that can separate the antenna from the first reflection region of the antenna reflector without significantly altering the amplitude distribution of the electromagnetic radiation emitted by the antenna in the first sub-band of frequencies, a step for determining a minimum distance $d_{Bmin}$ that can separate the antenna from the second reflection region of the antenna reflector without significantly altering the amplitude distribution of the electromagnetic radiation emitted by the antenna in the second sub-band of frequencies.

The invention notably offers the advantage of allowing a reflection coefficient to be maintained close to unity over a wide frequency band, nominally over the whole operating frequency band of the antenna.

BRIEF DESCRIPTION OF THE DRAWINGS

The invention will be better understood and other advantages will become apparent upon reading the description that follows, presented with reference to the appended drawings in which.

DETAILED DESCRIPTION

A perfect electrical conductor, or PEC, is a structure with a surface having an infinite electrical conductivity. The electric field tangent to this surface is therefore always zero. An incident electric field encountering the surface is reflected in phase opposition, irrespective of its frequency. In the following part of the description, the electrical conductors will be considered as perfect electrical conductors. A perfect magnetic conductor, or PMC, is a structure comprising a surface on which the tangential magnetic field is always zero. A magnetic field incident on this surface is cancelled, whereas the incident electric field is reflected in phase. Structures exhibiting properties of perfect magnetic conductors cannot be implemented in practice. It is nevertheless possible to form structures exhibiting electromagnetic properties close to perfect within a certain frequency band and for a given polarization. It is considered that a surface exhibiting electromagnetic properties close to a perfect magnetic conductor within a given frequency band is a surface for which the phase of the reflection coefficient at the frequencies in question is included between two values around 0°. The phase of the reflection coefficient is for example included between −120 and 120 degrees. A surface exhibiting electromagnetic properties close to a perfect magnetic conductor within a given frequency band is generally designated as being a high-impedance surface for this frequency band.

Figure 1:
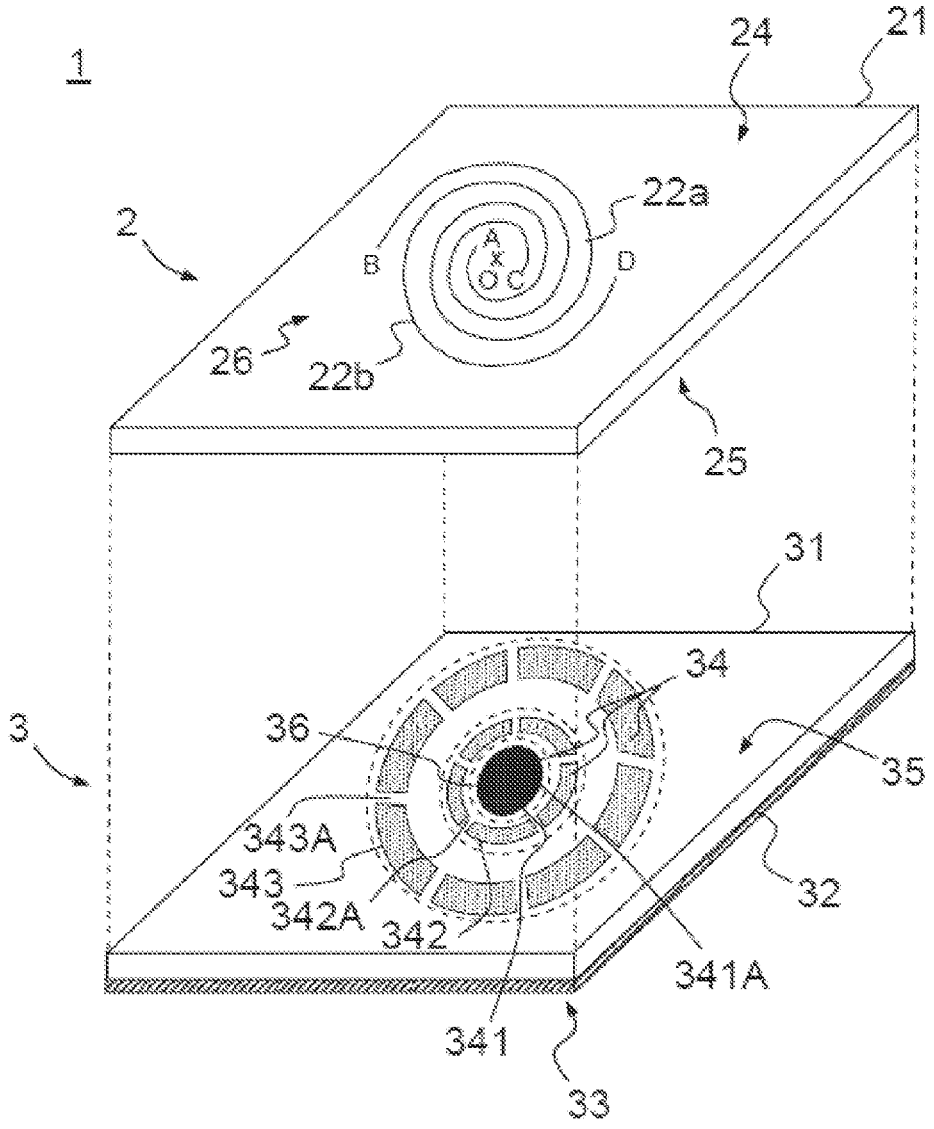
FIG. 1 shows one example of an antenna device comprising a spiral antenna and an antenna reflector according to the invention.

FIG. 1 shows one example of an antenna device 1 comprising a spiral antenna 2 and an antenna reflector 3 according to the invention. The spiral antenna 2 is capable of emitting over a predetermined frequency band, known as operating frequency band ΔF. It can emit electromagnetic radiation in two directions orthogonal to its plane. The electromagnetic radiation propagating in the direction opposite to the antenna reflector 3 is called forward radiation, and the electromagnetic radiation propagating in the opposite direction is called backward radiation. The spiral antenna 2 comprises a dielectric substrate 21 and two electrically conducting strands 22*a* and 22*b* forming the radiating element of the spiral antenna 2. The dielectric substrate 21 is for example an epoxide board of the printed circuit type. It comprises an upper surface 24 and a lower surface 25 substantially plane and parallel. The conducting strands 22*a* and 22*b* have an identical length and are mutually wound around a central point O so as to form a spiral 26 on the upper surface 24. The first strand 22*a* extends between an inner end A and an outer end B of the spiral 26. The second strand 22*b* extends between an inner end C and an outer end D of the spiral 26. The spiral antenna 2 also comprises means for powering the radiating element, not shown. Normally, the two strands 22*a* and 22*b* are powered on their inner ends A and C by microwave signals in phase opposition. The strands 22*a* and 22*b* may be printed or etched onto the upper surface 24. They may also be formed in an electrically-conducting material and fixed onto the upper surface 24.

In FIG. 1, a planar wire antenna of the Archimedes spiral type is formed. In such an antenna, each conducting strand has a constant thickness and a constant spacing with respect to the other strand. Nevertheless, the invention is also applicable to any type of circular-polarized planar wire antenna. It is notably applicable to equiangular spiral antennas, also called logarithmic spiral antennas, in which the width of the strands and the spacing between the strands increase with the distance from the center of the spiral. Similarly, the spiral antenna in FIG. 1 comprises two electrically conducting strands. However, the invention is also applicable to antennas comprising a different number of strands.

The antenna reflector, being the subject of the invention, uses the operating properties of planar wire antennas. The radiating element of such an antenna, when it is excited, emits electromagnetic radiation from a localized region of operation, associated with the relative arrangement of the strands and with the phase offset of the current flowing in the various strands. This region of operation exhibits the particularity of varying as a function of the frequency according to a law specific to each type of planar wire antenna. In particular, for an Archimedes spiral antenna whose strands are powered in phase opposition, the region of operation from which electromagnetic radiation is emitted at a given frequency forms a ring whose mean diameter is substantially equal to the wavelength of the electromagnetic radiation divided by the number Pi ($D=\lambda/\pi$). The antenna reflector according to the invention, on which an antenna is designed to be mounted, thus comprises at least two reflection regions whose electromagnetic properties are adapted to the electromagnetic radiation emitted locally by the antenna. A first reflection region exhibits electromagnetic properties of an electrical conductor, notably in a first sub-band of frequencies ΔF1. This sub-band of frequencies ΔF1 corresponds for example to high frequencies of the operating frequency band ΔF within which the planar wire antenna emits. A second reflection region exhibits electromagnetic properties close to a perfect magnetic conductor in a second sub-band of frequencies ΔF2. This second sub-band of frequencies ΔF2 corresponds for example to lower frequencies than those of the first sub-band of frequencies ΔF1. The antenna reflector thus comprises reflection regions of two different types, namely at least one reflection region exhibiting electromagnetic properties of an electrical conductor, and at least one reflection region exhibiting electromagnetic properties close to a perfect magnetic conductor. The antenna reflector can also comprise additional regions exhibiting either electromagnetic properties of an electrical conductor (reflection regions of the first type), or electromagnetic properties close to a perfect magnetic conductor (reflection regions of the second type) in other sub-bands of frequencies. Advantageously, these various sub-bands of frequencies are determined in such a manner as to cover, with the first sub-band of frequencies ΔF1, the whole of the operating frequency band ΔF. According to one particular embodiment, the regions exhibiting electromagnetic properties of an electrical conductor are alternated with regions exhibiting electromagnetic properties close to a perfect magnetic conductor.

In the exemplary embodiment shown in FIG. 1, the antenna reflector 3 comprises a dielectric substrate 31, a ground plane 32 carried by a lower surface 33 of the dielectric substrate 31, and three sets 341, 342, 343 of electrically-conducting patterns 34 carried by an upper surface 35 of the dielectric substrate 31. The dielectric substrate 31 can be an epoxide board of the printed circuit type whose upper surface 35 and lower surface 33 are substantially plane and parallel. The conducting patterns 34 can then be printed or etched onto the upper surface 35 of the dielectric substrate 31. More generally, they can be formed by any conventional technique for construction of printed circuits. They may also be formed in an electrically conducting material and fixed onto the upper surface 35. The lower surface 25 of the dielectric substrate 21 of the spiral antenna 2 is situated opposite the upper surface 35 of the dielectric substrate 31 of the antenna reflector 3. The dielectric substrate 21 may come directly into contact with the conducting patterns 34. The dielectric substrate 21 then fulfills a function of electromagnetic isolation between the spiral antenna 2 and the antenna reflector 3. This isolation may nevertheless be provided by any other means. Each set 341, 342, 343 of conducting patterns 34 is configured in such a manner as to form a reflection region whose electromagnetic properties may differ from those of the other regions in order to be adapted to the electromagnetic radiation to be reflected locally. The first set 341 of conducting patterns 34 only comprises a single conducting pattern in the shape of a disk. The conducting disk 36 thus forms a first reflection region 341A whose electromagnetic properties match those of an electrical conductor. This zone 341A therefore belongs to the first type of reflection region. In particular, the conducting disk 36 exhibits electromagnetic properties of an electrical conductor at least in the first sub-band of frequencies ΔF1. The antenna reflector 3 can thus be placed at a distance relatively close to the spiral antenna 2. The distance in question between the antenna reflector 3 and the spiral antenna 2 can be the distance between the upper surface 35 of the dielectric substrate 31 of the antenna reflector 3 and the upper surface 24 of the dielectric substrate 21 of the spiral antenna 2, called height h. Theoretically, the height h may be substantially equal to an odd integer multiple of a quarter of a wavelength of the central frequency of the first sub-band of frequencies ΔF1 ($(2\cdot N+1)\cdot\lambda/4$, where N is a natural integer), the backward reflected electromagnetic radiation then being in phase with the incident radiation on the upper surface 24 of the dielectric substrate 21 of the spiral antenna 2. The height h is for example substantially equal to a quarter of the wavelength of the central frequency of the first sub-band of frequencies ΔF1. The second set 342 of conducting patterns 34 comprises several non-conjoined electrically-conducting patterns 34 disposed on the upper surface 35 in such a manner as to form overall an annular reflection region 342A surrounding the conducting disk 36 and whose center substantially coincides with the center of the conducting disk 36. Similarly, the third set 343 of conducting patterns 34 comprises several non-conjoined conducting patterns 34 forming overall an annular reflection region 343A with a diameter greater than the diameter of the annular region 342A formed by the second set 342 of conducting patterns 34. The conducting patterns 34 of the second and third sets 342 and 343 may be electrically connected to the ground plane 32, for example by means of metallized holes formed in the dielectric substrate 31 of the antenna reflector 3. Each set 342 and 343 of conducting patterns 34 thus forms a reflection region exhibiting electromagnetic properties close to a perfect magnetic conductor. The geometric shape and the dimensions of the conducting patterns 34 are determined in such a manner that each annular reflection region 342A and 343A, designed to locally form a reflector for the region of operation of the spiral antenna 2 in a sub-band of frequencies ΔF2 or ΔF3, exhibits electromagnetic properties close to a perfect magnetic conductor at least in this sub-band of frequencies ΔF2 or ΔF3. The reflection regions 342A and 343A thus belong to the second type of reflection region. The antenna reflector 3 may also comprise other reflection regions whose electromagnetic properties match those of an electrical conductor (reflection regions of the first type). These reflection regions are designed to come to a distance from the antenna 2 so as to be able to reflect the electric field of the backward electromagnetic radiation substantially in phase with the electric field of the forward electromagnetic radiation on the upper surface 24 of the antenna 2. In theory, the height, or distance between these reflection regions and the antenna 2, must be substantially equal to an even integer multiple of a quarter of a wavelength of the central frequency of the respective sub-band of frequencies ($2\cdot N\cdot\lambda/4$, where N is a natural integer). In practice, the height may differ depending on the near field emitted by the antenna 2, as explained hereinbelow.

Figure 2:
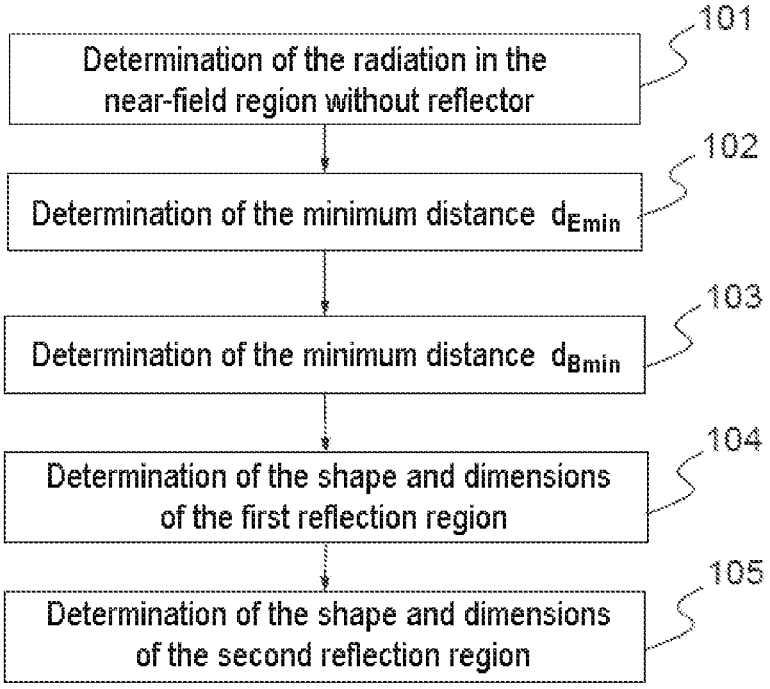
FIG. 2 shows possible steps in the method for implementing an antenna reflector according to the invention.

FIG. 2 illustrates possible steps of the method for implementing an antenna reflector according to the invention for a planar wire antenna. For the following part of the description, the particular case of a spiral antenna such as that shown in FIG. 1 continues to be considered. The method is nevertheless applicable to any type of circular-polarized planar wire antenna. In a first step 101, the electromagnetic radiation emitted by the spiral antenna 2 alone, in other words without the antenna reflector 3, is characterized for at least two frequencies belonging to the operating frequency band ΔF of the spiral antenna 2. It is of course possible to characterize the electromagnetic radiation over two sub-bands of frequencies belonging to the operating frequency band ΔF. For the rest of the description, it is considered that the electromagnetic radiation is characterized for the frequency sub-bands ΔF1, ΔF2 and ΔF3. More particularly, distributions are determined in amplitude and in phase of electromagnetic fields emitted by the spiral antenna 2 in the near field region in a plane substantially parallel to the plane of the spiral antenna 2, in this case, the upper surface 24. For this purpose, the conducting strands 22*a* and 22*b* of the spiral antenna 2 are powered on their inner ends A and C by electrical currents with the same amplitudes and, in general, having a phase difference of 180 degrees. As indicated hereinabove, the electromagnetic radiation emitted by the spiral antenna 2 has a maximum amplitude when the currents flowing in the strands 22*a* and 22*b* are locally in phase. In practice, the electromagnetic radiation emitted by the spiral antenna 2 at a given frequency has a maximum amplitude in a region forming a circular ring whose mean diameter is substantially equal to the wavelength of the electromagnetic radiation divided by the number Pi. In a second step 102, the minimum distance $d_{Emin}$ that can separate the spiral antenna 2 from an electrical conductor without altering the amplitude distribution of the electromagnetic radiation emitted by the spiral antenna 2 in the sub-band of frequencies ΔF1 is determined. The amplitude distribution is for example considered in the near field region. The distance in question is for example the height h between the upper surface 35 of the dielectric substrate 31 of the antenna reflector 3 and the upper surface 24 of the dielectric substrate 21 of the spiral antenna 2. The step 102 can be carried out over a wide frequency band, for example over the whole operating frequency band ΔF. In practice, the idea is essentially to determine the minimum distance that must separate the spiral antenna 2 from the reflection region 341A exhibiting electromagnetic properties of an electrical conductor. The step 102 is therefore carried out at least for the sub-band of frequencies ΔF1.

Figure 3A:
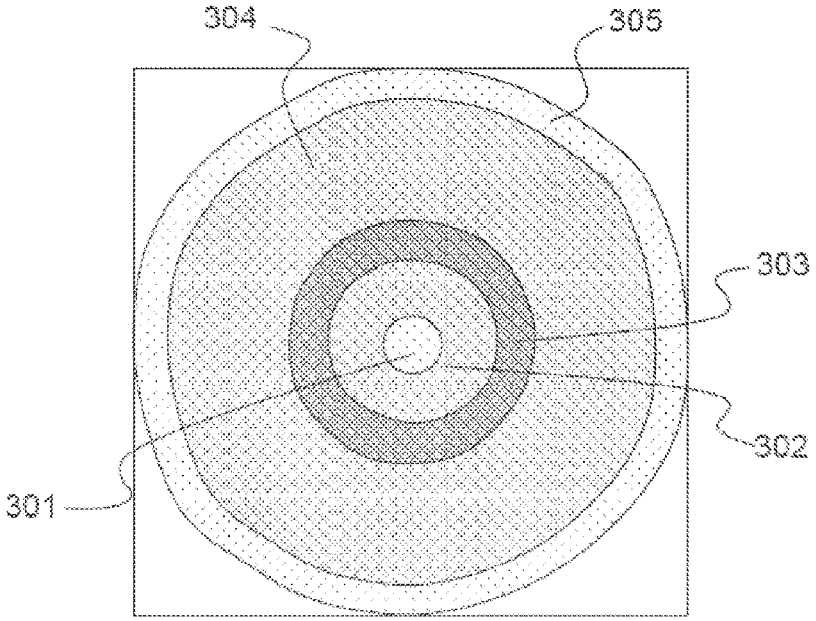
FIGS. 3*a* and 3*b* show examples of distributions of amplitude of the electromagnetic radiation emitted by a spiral antenna at a given frequency according to whether the electromagnetic radiation is altered or not by the presence of the antenna reflector.
Figure 3B:
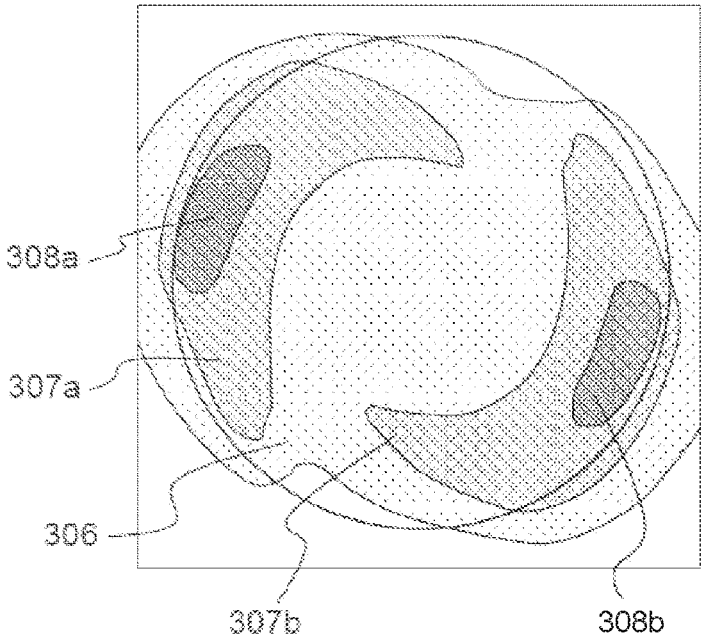

FIGS. 3*a* and 3*b* show two examples of distributions of amplitude of the electromagnetic radiation emitted by a spiral antenna 2 at a given frequency in a plane belonging to the near field region parallel to the plane of the spiral antenna 2. The first distribution, shown in FIG. 3*a*, is related to a distance between the spiral antenna 2 and the antenna reflector 3 for which the electromagnetic radiation is not altered; the second distribution, shown in FIG. 3*b*, relates to a distance for which the electromagnetic radiation is altered. In FIG. 3*a*, several different circular rings 301 to 305 corresponding to various amplitudes of the electrical energy density can be seen. The rings 301 and 305, 302 and 304, and 303 exhibit for example mean amplitudes respectively equal to $2.10^{-7}$ J/m$^3$, $6.10^{-7}$ J/m$^3$, and $1.5.10^{-6}$ J/m$^3$. The ring 303 thus corresponds to the region of operation of the spiral antenna 2 at the given frequency. The annular shape of the amplitude distribution allows it to be deduced that the electromagnetic radiation is not altered. In FIG. 3*b*, several different regions with an amplitude of irregular shape are seen. A first zone 306 exhibits a mean amplitude substantially equal to $2.10^{-7}$ J/m$^3$. Two regions 307*a* and 307*b* exhibit a mean amplitude substantially equal to $2.5.10^{-6}$ J/m$^3$, and two regions 308*a* and 308*b* exhibit a mean amplitude substantially equal to $5.5.10^{-6}$ J/m$^3$. The fact that the regions exhibiting a maximum amplitude do not form a continuous annular region allows it to be deduced that the electromagnetic radiation is altered. Of course, the altered or unaltered nature of the electromagnetic radiation must be examined according to the geometry of the antenna in question. In the case of a spiral antenna, the discriminating shape is a circular ring.

In a third step 103 of the method for implementing an antenna reflector 3 according to the invention, the minimum distance $d_{Bmin}$ that can separate the spiral antenna 2 from a perfect magnetic conductor without altering the amplitude distribution of the electromagnetic radiation emitted by the spiral antenna 2, at least in one of the sub-bands of frequencies ΔF2 and ΔF3, is determined. The amplitude distribution is for example considered in the near field region. The distance in question may also be the height h. The step 103 can be carried out over a wide frequency band, for example over the whole of the operating frequency band ΔF. In practice, the idea is essentially to determine the minimum distance $d_{Bmin}$ that needs to separate the spiral antenna 2 from the reflection regions 342A and 343A whose electromagnetic properties match those of a perfect magnetic conductor. The step 103 is therefore preferably carried out for the sub-bands of frequencies ΔF2 and ΔF3. Where appropriate, it is carried out for each of the sub-bands of frequencies in question outside of the frequency sub-band ΔF1. In a fourth step 104, the shape and the dimensions of the first reflection region 341A, exhibiting electromagnetic properties of an electrical conductor in the sub-band of frequencies ΔF1 (reflection region of the first type), are determined in such a manner that this reflection region 341A comes into the vicinity of the region of operation of the spiral antenna 2 in this sub-band of frequencies ΔF1. The step 104 essentially consists in determining the diameter of the conducting disk 36. In a fifth step 105, the shape and the dimensions of the reflection regions 342A and 343A, exhibiting electromagnetic properties close to a perfect magnetic conductor in the respective sub-bands of frequencies ΔF2 and ΔF3 (reflection regions of the second type), are also determined in such a manner that each reflection region 342A and 343A comes into the vicinity of the region of operation of the spiral antenna 2 in the respective sub-band of frequencies ΔF2 or ΔF3. The step 105 essentially consists in determining the inner and outer diameters of the reflection regions 342A and 343A together with the lengths of the arcs of circles radially bounding the conducting patterns 34. More generally, the step 105 consists in determining the location and the surface area of the conducting patterns 34 in such a manner that each set of conducting patterns forms a surface exhibiting electromagnetic properties close to a perfect magnetic conductor in a sub-band of frequencies. In the steps 104 and 105, it is considered that a reflection region comes into the vicinity of a region of operation of the spiral antenna 2 when it allows the electromagnetic radiation emitted by this region of operation to be reflected in the desired direction of radiation. It is to be noted that the steps of the method for implementing the antenna reflector 3 may be carried out in a different order, as long as the first step 101 is carried out prior to the steps 104 and 105.

Figure 4:
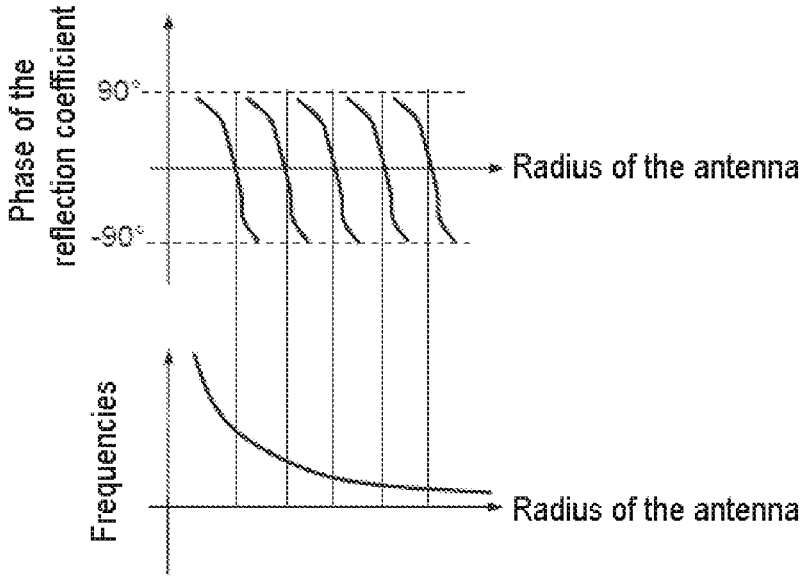
FIG. 4 shows one example of a phase diagram obtained in a step of the method for implementing an antenna reflector according to the invention.

The step 105 may, for example, be carried out by adapting conventional AMC structures. A conventional AMC structure comprises a dielectric substrate, a ground plane carried by a first surface of the dielectric substrate, and electrically-conducting patterns with a rectangular shape arranged according to a regular matrix and carried by a second surface of the dielectric substrate. The thickness of the dielectric substrate of the conventional AMC structure is preferably chosen to be equal to the thickness of the dielectric substrate 31 of the antenna reflector 3. An AMC structure exhibits electromagnetic properties close to a perfect magnetic conductor in a given sub-band of frequencies. In a first sub-step, for each sub-band of frequencies outside of the sub-band of frequencies ΔF1, the dimensions (length and width) of the conducting patterns of a conventional AMC structure are determined which allow a surface exhibiting properties close to a perfect magnetic conductor to be formed in the sub-band of frequencies in question. In the case of a spiral antenna, the surfaces of the conducting patterns forming the reflector become larger at greater distances from the center of the antenna reflector 3. In a second sub-step, for each of the sub-bands of frequencies in question, the conducting patterns of the conventional structures AMC are adapted to the corresponding region of operation of the spiral antenna 2, each adapted conducting pattern 34 conserving substantially the same surface area as that in the conventional AMC structure. In a spiral antenna, the conducting patterns 34 therefore take an overall annular shape, as shown in FIG. 1. In a third sub-step, a phase diagram is constructed resulting from the association of various phase diagrams, each being associated with one of the conventional AMC structures in question. FIG. 4 shows one example of such a phase diagram. Phases of the reflection coefficient of the various conventional AMC structures are plotted on a first graph as a function of the radius of the spiral antenna 2; the operating frequencies of the spiral antenna 2 are plotted on a second graph as a function of the radius of the spiral antenna 2. In a fourth sub-step, based on the phase diagram in FIG. 4, at least one set 342 of conducting patterns 34 is chosen which allows incident electromagnetic radiation to be reflected with a phase-shift substantially equal to zero degrees. Preferably, several sets of conducting patterns 34 are chosen, for example the two sets 341 and 342, in such a manner as to cover various regions of operation of the spiral antenna 2 without there being any overlap of conducting patterns 34 between various sets.

The antenna reflector 3 obtained by the method according to the invention is designed to receive a spiral antenna 2 at a minimum distance for which neither the first reflection region 341A nor the reflection regions 342A and 343A alter the electromagnetic radiation. The minimum distance preferably corresponds to the maximum between the distances $d_{Emin}$ and $d_{Bmin}$ determined in the steps 102 and 103. Given that the wavelengths of the electromagnetic radiation emitted in the first sub-band of frequencies ΔF1 are shorter than the wavelengths of the electromagnetic radiation emitted in the second sub-band of frequencies ΔF2, the electromagnetic radiations emitted in both the sub-band of frequencies ΔF1 and in the sub-band of frequencies ΔF2 can be in phase with the corresponding reflected electromagnetic radiations in the near field region. In order to maintain a reflection in phase over the whole operating frequency band ΔF of the spiral antenna 2, it is furthermore possible to vary the distance separating the spiral antenna 2 from the antenna reflector 3, or to use magneto-dielectric materials exhibiting various dielectric permittivities.

The invention claimed is:

1. An antenna reflector configured to receive a circular-polarized planar wire antenna configured to emit electromagnetic radiation in two directions orthogonal to a plane of the circular-polarized planar wire antenna over a predetermined frequency band, the antenna reflector comprising:

at least one first reflection region configured to reflect, with a phase-shift of 180 degrees, an electric field of the electromagnetic radiation as a backward radiation whose frequency is included within a sub-band of the frequency band, said at least one first reflection region being designed to face a region of the circular-polarized planar wire antenna configured to emit the electromagnetic radiation in a corresponding sub-band of frequencies, at a distance allowing the electric field of the backward radiation to be reflected substantially in phase with a forward radiation of the electric field of the electromagnetic radiation, and at least one second reflection region configured to reflect, with a phase-shift included between two values of an angle on either side of zero degrees, the electric field of the backward radiation whose frequency is included within the sub-band of the frequency band, each of said at least one first and said at least one second reflection regions being designed to face a region of the circular-polarized planar wire antenna configured to emit the electromagnetic radiation in the corresponding sub-band of frequencies, at a distance allowing the electric field of the backward radiation to be reflected substantially in phase with the electric field of the forward radiation, wherein the at least one first reflection region and the at least one second reflection region are different and separated by a gap; and wherein each of the at least one first reflection region and the at least one second reflection region is distributed separately and concentrically around a center of the circular-polarized planar wire antenna.

2. The reflector as claimed in claim 1 comprising several second reflection regions, each of said second reflection regions being designed to face the region of the circular-polarized planar wire antenna able to emit the electromagnetic radiation in the sub-band of frequencies at the distance allowing the electric field of the backward radiation to be reflected substantially in phase with the electric field of the forward electromagnetic radiation.

3. The reflector as claimed in claim 1 further comprising a single reflection region at a center of the at least one second reflection region or at least two second reflection regions.

4. The reflector as claimed in claim 3, in which the sub-band of frequencies of the at least one first reflection region corresponds to one or more of highest frequencies of the predetermined frequency band.

5. The reflector as claimed in claim 1, in which the sub-bands of frequencies of the various reflection regions are separate from one another and, taken as a whole, cover substantially the whole of the predetermined frequency band.

6. The reflector as claimed in claim 1, further comprising a substrate made of a dielectric material and a ground plane formed on a first surface of the substrate, the at least one first reflection region being formed on a second surface of the substrate by an electrically conducting pattern, the at least one second reflection region being formed on the second surface of the substrate by a set of electrically-conducting patterns disposed in a non-conjoined manner.

7. The reflector as claimed in claim 6, in which the first and second surfaces of the substrate are substantially plane and parallel to each other.

8. The reflector as claimed in claim 6, in which the second surface of the substrate has a conical shape.

9. The antenna reflector as claimed in claim 6, in which the electrically-conducting patterns of sets forming the at least one second reflection region are electrically connected to the ground plane.

10. The reflector as claimed in claim 1, in which for each of the at least one second reflection region, the two values of the angle on either side of zero degrees are equal to −120 degrees and +120 degrees.

11. An antenna device comprising a circular-polarized planar wire antenna capable of emitting electromagnetic radiation over a predetermined frequency band and an antenna reflector (3) as claimed in claim 1.

12. A method for implementing an antenna reflector for a circular-polarized planar wire antenna capable of emitting electromagnetic radiation in two directions orthogonal to a plane of the circular-polarized planar wire antenna over a predetermined frequency band, the method comprising:

determining, in a near-field region, an amplitude distribution of electromagnetic radiation emitted by the circular-polarized planar wire antenna in an absence of the antenna reflector for at least a first and a second sub-band of frequencies belonging to the predetermined frequency band, determining a shape and dimensions of a first reflection region of the antenna reflector designed to reflect, with a phase-shift of 180 degrees, an electric field of the electromagnetic radiation as a backward radiation whose frequency is included within the first sub-band of frequencies, in such a manner that the first reflection region is situated facing a region of the circular-polarized planar wire antenna where the electromagnetic radiation to be emitted by the circular-polarized planar wire antenna in the first sub-band of frequencies has a highest amplitude, at a distance allowing the electric field of the backward radiation to be reflected substantially in phase with a forward radiation of the electric field of the electromagnetic radiation, and determining a shape and dimensions of a second reflection region of the antenna reflector designed to reflect, with a phase-shift included between two values of an angle on either side of zero degrees, the electric field of the backward radiation whose frequency is included in the second sub-band of frequencies, in such a manner that the second reflection region is situated facing the region of the antenna where the electromagnetic radiation to be emitted by the circular-polarized planar wire antenna in the second sub-band of frequencies has the highest amplitude, at a distance allowing the electric field of the backward radiation to be reflected substantially in phase with the electric field of the forward radiation;

wherein the first reflection region and the second reflection region are different and separated by a gap; and wherein each of the first reflection region and the second reflection region is distributed separately and concentrically around a center of the circular-polarized planar wire antenna.

13. The method as claimed in claim 12, further comprising:

determining a minimum distance $d_{Emin}$ to separate the circular-polarized planar wire antenna from the at least one first reflection region of the antenna reflector without significantly altering the amplitude distribution of the electromagnetic radiation emitted by the circular-polarized planar wire antenna in the first sub-band of frequencies, and determining a minimum distance $d_{Bmin}$ to separate the circular-polarized planar wire antenna from the at least one second reflection region of the antenna reflector without significantly altering the amplitude distribution of the electromagnetic radiation emitted by the circular-polarized planar wire antenna in the second sub-band of frequencies.

* * * * *